US006223731B1

(12) United States Patent
Yoshiume et al.

(10) Patent No.: US 6,223,731 B1
(45) **Date of Patent: *May 1, 2001**

(54) FUEL FEEDING APPARATUS WITH RESPONSE DELAY COMPENSATION

(75) Inventors: Naoki Yoshiume; Shigenori Isomura, both of Kariya (JP)

(73) Assignee: Denso Corporation, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/920,728

(22) Filed: Aug. 29, 1997

(30) Foreign Application Priority Data

| | | |
|---|---|---|
| Sep. 9, 1996 | (JP) | 8-237567 |
| Feb. 14, 1997 | (JP) | 9-029934 |
| Apr. 23, 1997 | (JP) | 9-105482 |

(51) Int. Cl.[7] ..... F02M 57/04
(52) U.S. Cl. ..... 123/497; 123/456
(58) Field of Search ..... 123/499, 457, 123/456, 357

(56) References Cited

U.S. PATENT DOCUMENTS

| | | | | |
|---|---|---|---|---|
| Re. 33,270 | | 7/1990 | Beck et al. . | |
| 4,359,984 | | 11/1982 | Nakao . | |
| 4,526,151 | * | 7/1985 | Tateishi | 123/468 |
| 4,660,524 | * | 4/1987 | Bertsch | 123/468 |
| 4,800,859 | | 1/1989 | Sagisaka et al. . | |
| 5,211,150 | | 5/1993 | Anzai . | |
| 5,215,062 | | 6/1993 | Asano et al. . | |
| 5,355,859 | | 10/1994 | Weber . | |
| 5,361,742 | | 11/1994 | Briggs et al. . | |
| 5,365,906 | | 11/1994 | Deweerdt . | |
| 5,367,999 | | 11/1994 | King et al. . | |
| 5,377,645 | | 1/1995 | Moore . | |
| 5,379,741 | * | 1/1995 | Matysiewicz | 123/497 |
| 5,398,655 | | 3/1995 | Tuckey . | |
| 5,406,922 | | 4/1995 | Tuckey . | |
| 5,421,306 | | 6/1995 | Talaski . | |
| 5,429,094 | * | 7/1995 | Akiba | 123/467 |
| 5,448,977 | | 9/1995 | Smith et al. . | |
| 5,477,829 | | 12/1995 | Hassinger et al. . | |

(List continued on next page.)

FOREIGN PATENT DOCUMENTS

| | | |
|---|---|---|
| 57-68529 | 4/1982 | (JP) . |
| 4-63929 | 2/1992 | (JP) . |
| 6-147047 | 5/1994 | (JP) . |
| 6-173805 | 6/1994 | (JP) . |
| 7-1374 | 1/1995 | (JP) . |
| 7-27029 | 1/1995 | (JP) . |

*Primary Examiner*—Carl S. Miller
(74) *Attorney, Agent, or Firm*—Nixon & Vanderhye

(57) ABSTRACT

A fuel transfer model of a fuel supply system is used to set and control the fuel pump of a return less fuel injection system. The model simulates characteristics of the fuel pump, fuel pressure transfer delay of fuel supply conduits and fuel pressure variation characteristics such as caused by expansion and compression of the fuel supply conduit volume due to an elastic coefficient and the like. The fuel pump model simulates a torque applied to the fuel pump motor, inertia, and the relationships between pump rotational speed, fuel pressure and fuel pump discharge amounts. A compensation control arithmetic calculation model may be derived from inverse calculation based on this fuel transfer model. The compensating current obtained from such an arithmetic model provides compensation for control of the fuel pump by adding a first value obtained by waveform shaping (through a first differentiation of the fuel injection amount) and a second value obtained by waveform shaping (through a second differentiation of the fuel injection amount).

11 Claims, 10 Drawing Sheets

U.S. PATENT DOCUMENTS

| | | | | |
|---|---|---|---|---|
| 5,483,940 | | 1/1996 | Namba et al. . | |
| 5,499,608 | * | 3/1996 | Meister | 123/467 |
| 5,546,911 | | 8/1996 | Iwamoto et al. . | |
| 5,586,539 | | 12/1996 | Yonekawa et al. . | |
| 5,715,797 | * | 2/1998 | Minagawa | 123/497 |
| 5,749,344 | * | 5/1998 | Yoshiume | 123/497 |
| 5,752,486 | * | 5/1998 | Nakashima | 123/467 |

* cited by examiner

FUEL FEEDING APPARATUS WITH RESPONSE DELAY COMPENSATION

CROSS REFERENCE TO RELATED APPLICATION

This application is related to and incorporates herein by reference Japanese patent Applications No. 8-237567 filed on Sep. 9, 1996, No. 9-29934 filed on Feb. 14, 1997 and No. 9-105482 filed on Apr. 23, 1997.

BACKGROUND OF THE INVENTION

1. Field of the Invention:

The present invention relates to adjusting the fuel pressure supplied to an internal combustion engine by controlling a fuel pump.

2. Description of Related Art:

A returnless piping structure having no fuel return to the fuel tank for surplus fuel fed to an engine fuel injector has been employed to simplify the fuel conduit and thus realize a reduction in size and cost. In this case, as described in Japanese Patent Application Laid-open No. 6-147047, a fuel pressure sensor detects piping system pressure and provide a voltage to a built-in fuel pump motor that is controlled through a feedback loop so that fuel pressure matches the target fuel pressure.

However, in this system, since the amount of fuel discharged from the fuel pump increases after the amount of fuel consumed in the engine increases, for example, during a transition period (engine acceleration) where the amount of fuel injected from the injector increases quickly, fuel pressure is temporarily lowered due to delay in both control response and fuel transfer. On the contrary, when the amount of fuel discharged from the fuel pump is reduced after the amount of fuel consumed in the engine is decreased during a transition period (engine deceleration) where the amount of fuel injection reduces quickly, fuel pressure is temporarily increased due to delayed control responses. Such variation of fuel pressure causes deviation of the air-fuel ratio supplied to the internal combustion engine and thus also results in deterioration of exhaust emission and drivability.

In order to avoid such drawbacks, it is proposed that such delay of transition responses be compensated by detecting the rate of transitional variation of the requested amount of fuel injection and then calculating with mapped data stored in a memory an appropriate compensating value depending on such rate of transitional variation.

However, the system has a disadvantage in that the arithmetic operations required are rather complicated and a large amount of memory capacity is required because it is required, as explained above, to detect a rate of transitional variation of the requested amount of fuel injection and to calculate with the mapped data the compensating value depending on such a rate of transitional variation.

SUMMARY OF THE INVENTION

The present invention provides a fuel feeding apparatus for internal combustion engine which can improve fuel pressure control in the transitional period with rather simplified arithmetic operations or with hardware of simplified structure.

According to a first aspect of the present invention, the compensation amount corresponding to a response delay of the fuel feeding system generated in the transitional operation of an internal combustion engine is calculated using a fuel transfer model from the fuel tank to an injector. A fuel pump is driven on the basis of the basic control amount and the amount of control calculated on the basis of the compensation amount for response delay so that transitional response delay in control and fuel transfer may be suppressed and thereby resultant variation of fuel pressure during the transitional period can also be controlled. Thus, it is no longer required to detect the rate of transitional variation of the requested amount of fuel injection because the compensation amount for delay of response is calculated using a fuel transfer model.

According to a second aspect of the present invention, the compensation is calculated on the basis of the difference between a first-order delay in the amount of fuel injection and the actual amount of fuel injection of the fuel injector. That is, as the variation in the amount of fuel injection changes more quickly, the difference between the first-order delay in the amount of fuel injection and the actual amount of fuel injection becomes larger, and adequate delay compensation can be calculated depending on the rate of transitional variation in the amount of fuel injection. In this case, the difference between the primary delay in the amount of fuel injection and the actual amount of fuel injection can be obtained with simplified arithmetic operations or hardware of simplified structure, resulting in simplified arithmetic operations.

According to a third aspect of the present invention, a delay compensation is calculated depending on the amount of variation of the amount of fuel injection of the fuel injector. That is, since variation in the amount of fuel injection causes variation of fuel pressure, adequate delay compensation can be calculated depending on the rate of transitional variation of fuel injection by calculating of compensation delay on the basis of the variation of the amount of fuel injection. In this case, variation of the amount of fuel injection can also be obtained with simplified arithmetic operations or hardware of simplified structure, resulting in simplified arithmetic operations for the delay compensation.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

DETAILED DESCRIPTION OF THE PREFERRED EMBODIMENTS

Figure 1:
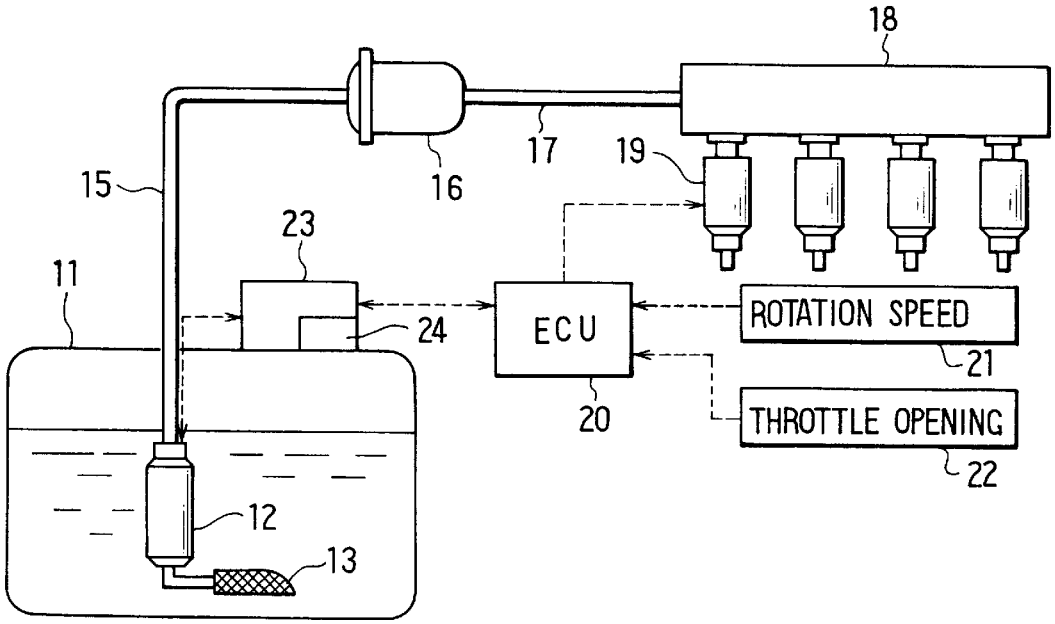
FIG. 1 is a schematic structural diagram of a fuel feeding system showing the first embodiment of the present invention.

The present invention will be described hereunder with reference to various embodiments throughout which the same or similar parts are designated by the same or similar reference numerals.

(First Embodiment)

The first embodiment of the present invention will be described with reference to FIG. 1 to FIG. 11. First, the whole structure of a fuel feeding system as a whole will be explained with reference to FIG. 1. A fuel pump 12 is installed within a fuel tank 11 and a fuel strainer 13 is attached to a suction port of the fuel pump 12. The fuel pump 12 comprises a DC motor (not illustrated) as a drive source. The fuel discharged from the fuel pump 12 is sent to a delivery pipe 18 through the route of fuel pipe 15→fuel filter 16→fuel pipe 17. The fuel is injected into cylinders from the injectors 19 attached to this delivery pipe 18. This fuel distribution pipe system is of the returnless piping type which has no return pipe to return the surplus fuel to the fuel tank 11 from the delivery pipe 18, in order to simplify the structure.

An engine control unit 20 reads various kinds of sensor information such as the engine rotation speed Ne output from a sensor 21 and the throttle opening angle output from a throttle sensor 22, etc. to drive each injector 19 by calculating the ignition timing, amount of fuel injection, target fuel pressure, etc. It also controls a constant current type control circuit (fuel pump control circuit) 23 to drive the fuel pump 12.

This constant current type control circuit 23 is a current feedback circuit for feedback control of a control current value to drive the fuel pump 12 with a control signal from the engine control unit 20. The control signal input to the constant current type control circuit 23 from the engine control unit 20 is input in the form of a duty signal, the constant current type control circuit 23 converts the input duty signal to the target current value for the feedback control so that the control current value of the fuel pump 12 becomes the target current value. Here, an analog signal may be used as the control signal from the engine control unit 20 in place of the duty signal.

Figure 2:
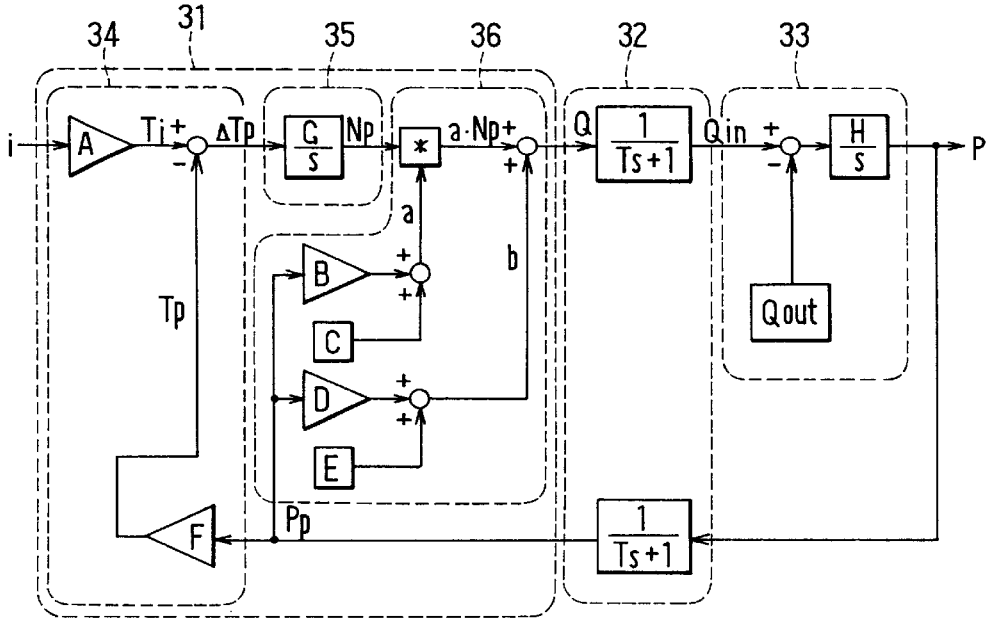
FIG. 2 is a structural diagram of a fuel transfer model.

The constant current type control circuit 23 comprises a compensating current calculating circuit 24 for calculating a compensating current value (compensation amount for delay of response) for compensating a control current value of the fuel pump 12 based on the fuel transfer model of the fuel feeding system shown in FIG. 2 and compensates for the target current value input from the engine control unit 20 with the compensating current value calculated by the compensating current calculating circuit 24. It is also possible to incorporate the compensating current calculating circuit 24 into the engine control unit 20 so that the control signal after compensation for delay of response is input to the constant current type control circuit 23.

Next, the fuel transfer model will be explained with reference to FIG. 2 in which "A" through "H" indicate constants and "T" indicates a time constant. The fuel transfer model is formed through combination of a model 31 simulating the characteristic of the fuel pump 12, a model 32 simulating a fuel transfer delay of the fuel feeding system from the fuel tank 11 to injector 19 and a model 33 simulating expansion and compression of volume of pipe depending on the elasticity coefficient of the fuel feeding system as a whole. Moreover, the model 31 simulating the characteristic of the fuel pump 12 is composed of the model 34 simulating a torque applied to the motor of the fuel pump 12, model 35 simulating inertia and model 36 simulating relationship among the rotation speed of fuel pump 12, fuel pressure and discharge amount of fuel.

First, the model 34 simulating a torque applied to the motor of the fuel pump 12 will be explained. The torque $\Delta Tp$ applied to the built-in motor of the fuel pump 12 can be obtained from difference between a torque Ti generated by a control current i and a consuming torque Tp due to raised pressure loss, etc.

$$\Delta Tp = Ti - Tp$$

Here, a generated torque Ti can be obtained by the following formula.

$$Ti = \alpha \cdot \phi \cdot Z \cdot i$$ ($\alpha$: Constant, $\phi$: Magnetic flux of magnet, Z: Coil resistance)

As will be apparent from this formula, the generated torque Ti is determined by the magnetic flux of magnet $\phi$ and the coil resistance Z, etc. These parameters are different depending on a kind of fuel pump 12, but the torque Ti can also be obtained by the following formula where $\alpha \cdot \phi \cdot Z$ are replaced with only one constant A.

$$Ti = A \cdot i \quad (1)$$

Moreover, the torque Tp to be consumed is determined by the shape of pump (pressure receiving area) of the fuel pump 12 and fuel pressure Pp in the pump to be transferred to the fuel pump 12 from the delivery pipe 18 via the fuel pipes 15 and 17 and such torque can be calculated by multiplying the fuel pressure Pp with a constant F for conversion to torque.

$$Tp = F \cdot Pp \quad (2)$$

In the model 34 of FIG. 2, a torque applied on the motor of the fuel pump 12 is simulated using the formulae (1) and (2), but the torque $\Delta Tp$ applied to the motor of fuel pump 12 having higher accuracy can be obtained, considering pressure loss Tq of a fluid and loss torque Tn of motor.

$$\Delta Tp = Ti - (Tp + Tq + Tn)$$

Figure 3:
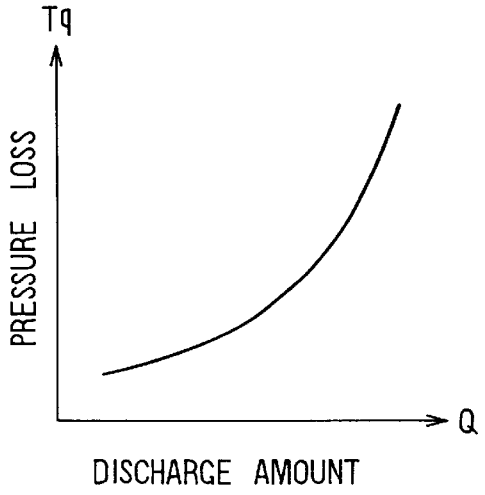
FIG. 3 is a graph showing relationship between amount of discharge Q and pressure loss Tq of a fuel pump.

Here, pressure loss Tq can be obtained as shown in FIG. 3 from the following formula based on the discharge amount Q of the fuel pump 12.

$$Tq=f1(Q)$$

(f1: Function using discharge amount Q as a parameter)

Figure 4:
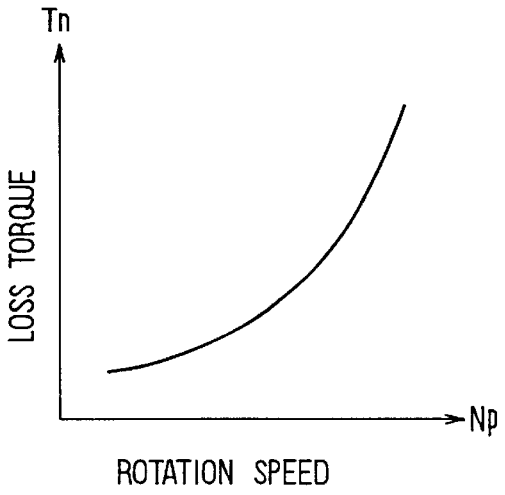
FIG. 4 is a diagram showing relationship between rotation speed Np and loss torque Tn of a fuel pump.

Moreover, loss torque Tn can be obtained as shown in FIG. 4 from the following formula based on the rotation speed Np of the fuel pump 12.

$$Tn=f2(Np)$$

(f2: Function using the speed Np as a parameter)

Meanwhile, a transfer function of the model 35 simulating an inertia becomes G/s (G: Constant). The rotation speed Np can be obtained by integrating the torque ΔTp applied to the fuel pump 12 with the transfer function G/s of the model 35 of this inertia.

Figure 5:
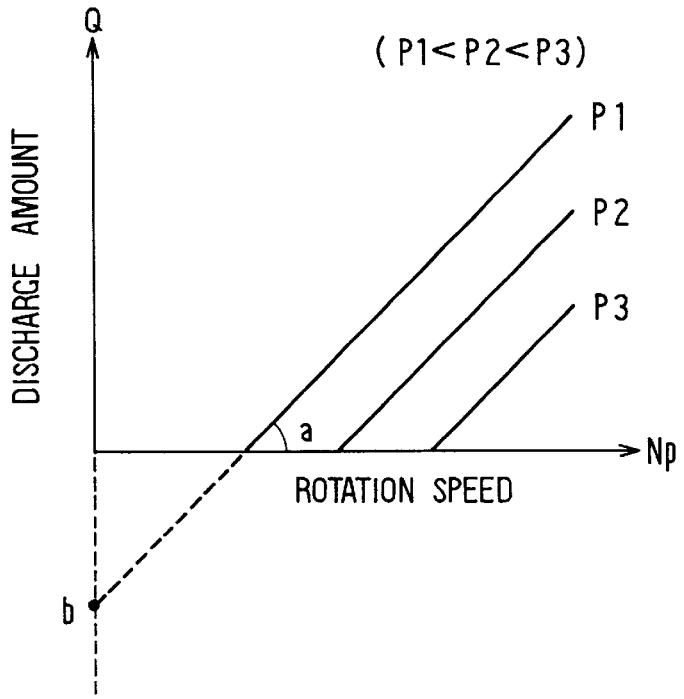
FIG. 5 is a diagram showing relationship among rotation speed Np, amount of discharge Q and fuel pressure of a fuel pump.

Next, the model 36 simulating relationship among the rotation speed Np, fuel pressure Pp and discharge amount Q of the fuel pump 12 will be explained. As shown in FIG. 5, the model 36 has the characteristic that the higher the rotation speed Np is, the more the discharge amount Q increases and the higher the fuel pressure Pp (P1<P2<P3) is, the more the discharge amount Q decreases. This characteristic can be expressed by the following formula.

$$Q=a\cdot Np+b \tag{3}$$

Here, a indicates a gradient of the straight characteristic line of FIG. 5 and b, a segment on the vertical axis obtained by the following formulae.

$$a=B\cdot Pp+C \tag{4}$$

$$b=D\cdot Pp+E \tag{5}$$

(B, C, D, E: Constant)

In this model 36, the gradient a and the segment b of the vertical axis in FIG. 5 are obtained by executing the arithmetic operations indicated by the formulae (4), (5) on the basis of the fuel pressure Pp in the fuel pump 12 and the discharge amount Q of the formula (3) is obtained using these values a, b and the rotation speed Np as an output value of the model 35 of inertia. Thereby, the discharge amount Q of the fuel pump 12 can be obtained with high accuracy.

Next, the model 32 simulating a fuel pressure transfer delay of the fuel pipes 15, 17 will be explained. Transfer of fuel pressure in the fuel pipes 15, 17 can be detected by dividing the fuel pipes 15, 17 into many sections with a very small interval or short length and then obtaining the force applied to the fluid due to a pressure difference between adjacent two areas, but in this model 32, such transfer of fuel pressure is approximated by the primary or first-order delay in order to detect only the characteristic of transfer of fuel pressure. Since the transfer delay (time constant: T) changes depending on the shape and material of the fuel pipes 15, 17, the time constant T must be matched to each type of vehicle.

Next, the model 33 simulating expansion and compression of pipe volume depending on an elastic coefficient E of the fuel pipe system (including the delivery pipe 18) will be explained. A change P/dt of fuel pressure of the fuel pipe system can be obtained by multiplying a ratio of the difference between the fuel intake amount Qin and fuel discharge amount Qout of the fuel pipe system to the volume V with an elastic coefficient E.

$$P/dt=\{(Qin-Qout)/V\}\cdot E$$
$$=(Qin-Qout)\cdot H$$

(Where, H=E/V)

In this model 33, the respective values used are summarized in the fuel feeding system as a whole in order to detect the characteristic as in the case of the transfer delay.

Qin: Amount of delayed discharge of fuel pump 12;

Qout: Amount of fuel consumed by engine;

V: Total volume of the fuel pipe system including fuel pump 12 and fuel filter 16;

E: Total elastic coefficient with elasticity of fuel.

Figure 6:
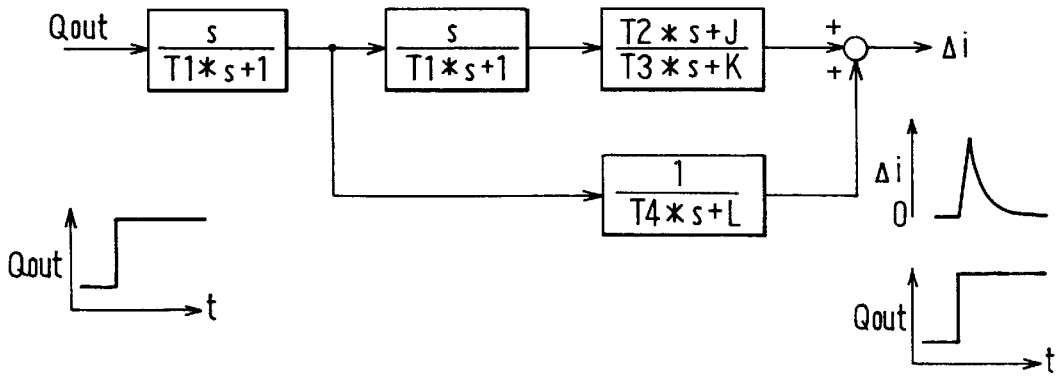
FIG. 6 is a structural diagram of a compensating current arithmetic operation model.

A compensating current arithmetic operation model shown in FIG. 6 can be derived from the fuel transfer model structured as explained above. In FIG. 6, "T1" through "T4" indicate time constants (T1≈0) and "J" through "L" indicate constants. This compensating current arithmetic operation model calculates compensating current Δi from the amount of fuel injection (amount of fuel consumed by the engine) of the injector 19 and is set to inversely calculate the formula of the fuel transfer model (that is, this model is an inverse model of the fuel transfer model). This compensating current arithmetic operation model obtains a compensating current (compensation amount for delay of response) Δi by adding the value of the amount of fuel injection Qout obtained after waveform shaping by the single (first) differentiation and the value of the amount of fuel injection Qout obtained after waveform shaping by the double (second) differentiation. The target current value may be compensated by adding this compensating current Δi to the target current value (basic control amount) ibas set by the engine control unit 20 to compensate for the control current i of the fuel pump 12. A series of these operations are executed by software or hardware by the constant current type control circuit 23 comprising the compensating current arithmetic operation circuit 24.

Figure 9:
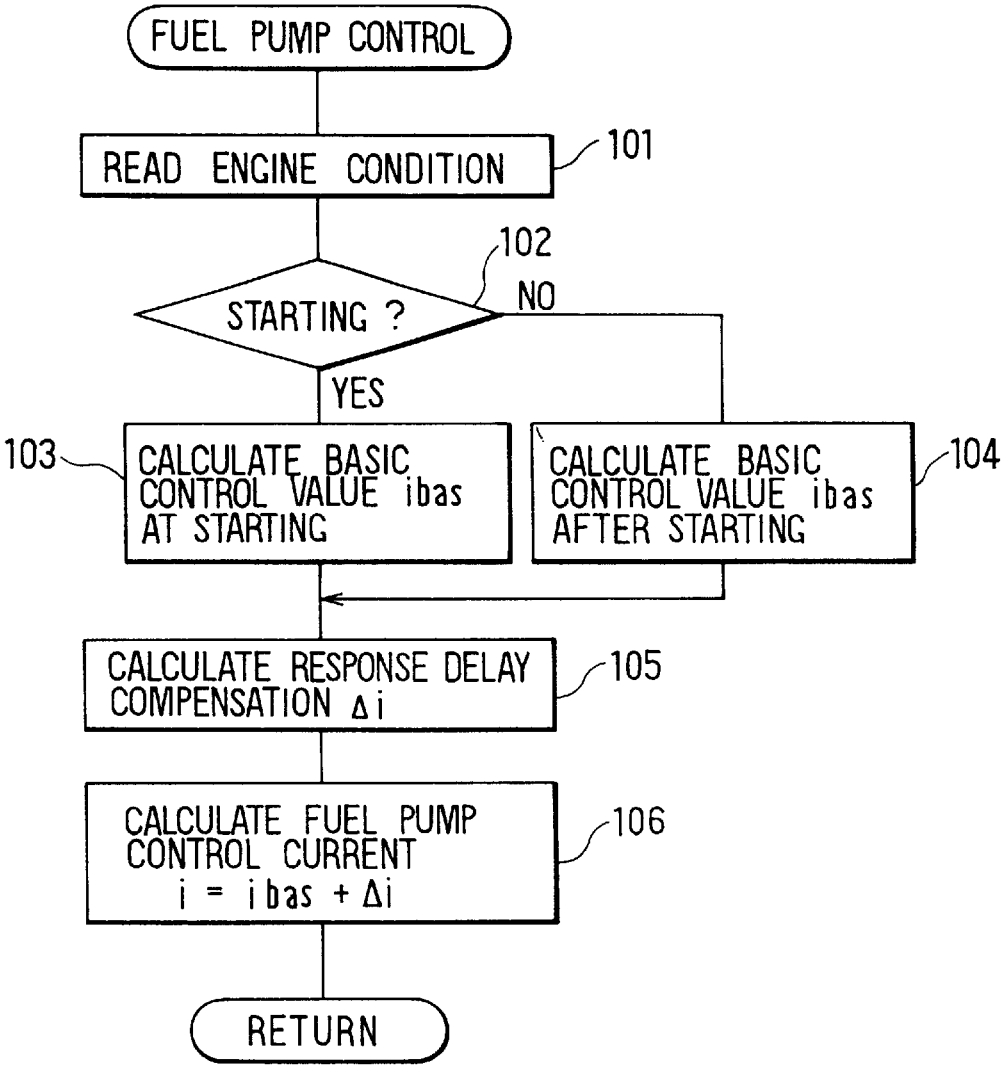
FIG. 9 is a flow chart showing a flow of process of a fuel pump control program.

Next, an example of the control method of the fuel pump 12 using the fuel transfer model (compensating current arithmetic operation model) will be explained with reference to the flowchart of FIG. 9. First, in the step 101, the running condition of engine (for example, the rotation speed of engine, amount of fuel injection, pressure of absorbing pipe, temperature of engine cooling water, etc.) is read and whether it is the time of starting or not is determined in the step 102. When it is the time of starting, the basic control amount ibas at the time of starting (target fuel pressure at the time of starting) is set in the step 103 depending, for example, on the temperature of engine cooling water. In this case, for example, as shown in FIG. 10, the higher target fuel pressure at the time of starting is set as the temperature of engine cooling water is higher, because the starting characteristic must be improved by controlling generation of vapor in the fuel pipe at the time of engine restarting at high temperature.

Figure 10:
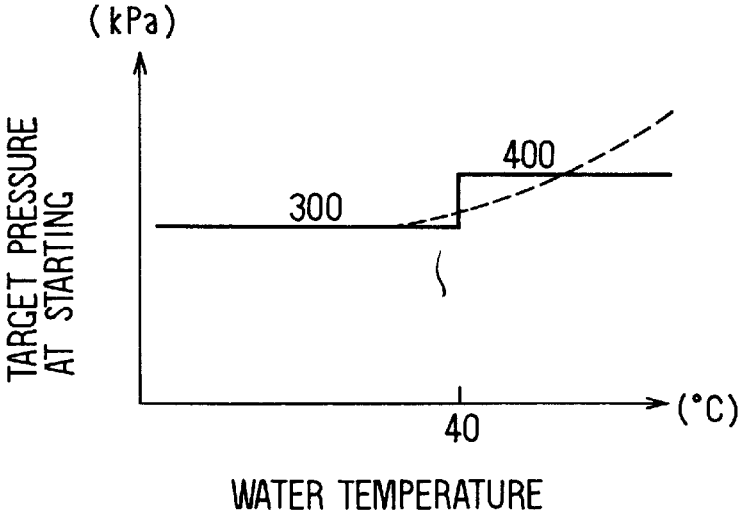
FIG. 10 is a diagram showing an example of mapped data for setting the target fuel pressure at the time of engine starting depending on the temperature of coolant of engine.

In the example of FIG. 10, the target fuel pressure at the time of starting is set in two stages depending on temperature of the engine cooling water, but such target fuel pressure may be set in three or more stages. Otherwise, as indicated by a dotted line in FIG. 10, the target fuel pressure at the starting time may be set continuously depending on the temperature of engine cooling water based on the saturated vapor pressure characteristic of fuel, in place of changing step by step the target fuel pressure at the engine starting time and moreover the target fuel pressure at the starting time may also be changed linearly depending on the temperature of engine cooling water for simplification. In addition, the target fuel pressure at the starting time may also be set depending on fuel temperature or intake air temperature by detecting such fuel temperature or intake air temperature in the delivery pipe 18 in place of the cooling water temperature. In addition, it is also possible, to simplify the operation, to always control the target fuel pressure at the starting time to a constant high pressure.

Figure 11:
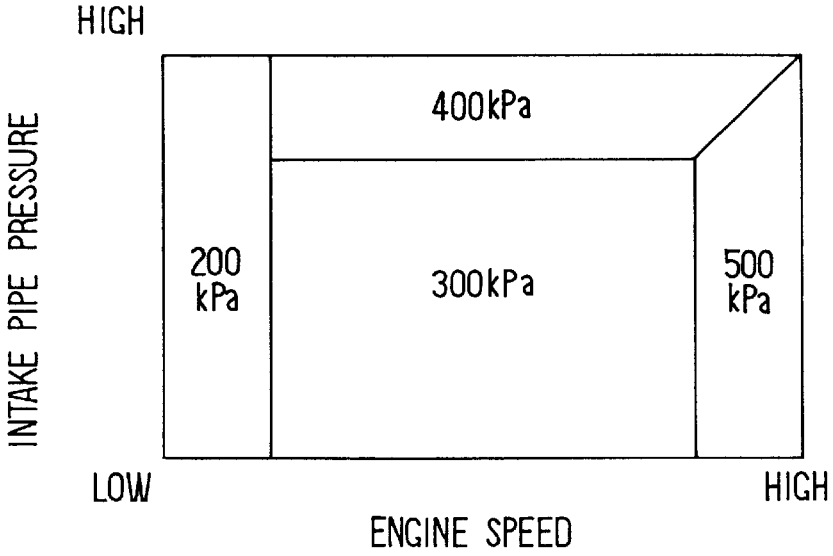
FIG. 11 is a diagram showing an example of mapped data for setting the target fuel pressure after the engine starting depending on the rotation speed and the intake pipe pressure of an engine.

Meanwhile, when starting is once executed, operation proceeds to the step 103 from the step 102 to set the basic control value ibas after the starting (target fuel pressure after the starting), for example, depending on a load of engine. FIG. 11 shows an example of a mapped data for setting the target fuel pressure after starting. In this map, the target fuel pressure after the starting is set low at the time of lower load or set high at the time of heavy load with the rotation speed of engine and intake pipe pressure as the engine load information varied as the parameters. Thereby, noise sound reduction and improvement of fuel consumption (reduction of electric power consumption) of the fuel pump 12 under the lower load condition can be realized and the target fuel pressure can be set high under the heavy load condition in view of improving the engine performance. The map of FIG. 11 is only an example and it is of course possible to change the setting value of the target fuel pressure as required. Moreover, the target fuel pressure may be set depending only on any one of the rotation speed of engine and intake pipe pressure. In addition, the target fuel pressure may be set using the other information such as cooling water temperature, intake air temperature and fuel temperature, etc.

Moreover, the target fuel pressure after the starting may also be fixed to the constant pressure.

Meanwhile, the target fuel pressure before the starting and the target fuel pressure after the starting may also be set to the constant fuel pressure. In this case, the operations in the steps 102 to 104 may be eliminated. The steps 102 to 104 thus calculates the basic control amount.

After setting of the basic control amount ibas (target fuel pressure), operation goes to the step 105 to calculate the amount Δi of compensation for delay of response (compensating current) based on the inverse model (compensating current arithmetic operation model) of the fuel transfer model from the fuel tank 11 to the injector 19.

After calculation of the amount Δi of compensation for delay of response, operation goes to the step 106 to calculate a control current i of the fuel pump 12 by adding the amount Δi of compensation for delay of response to the basic control amount ibas in order to control the fuel pump 12 with this control current i.

Operations in the steps 101 to 104 are executed by the engine control unit 20 and operations in the steps 105 and 106 are executed in the constant current type control circuit 23.

Next, the effect of compensating for the control current of the fuel pump 12 using the fuel transfer model (compensating current arithmetic operation model) will be explained using the time charts of FIG. 7 and FIGS. 8A–8D.

Figure 7:
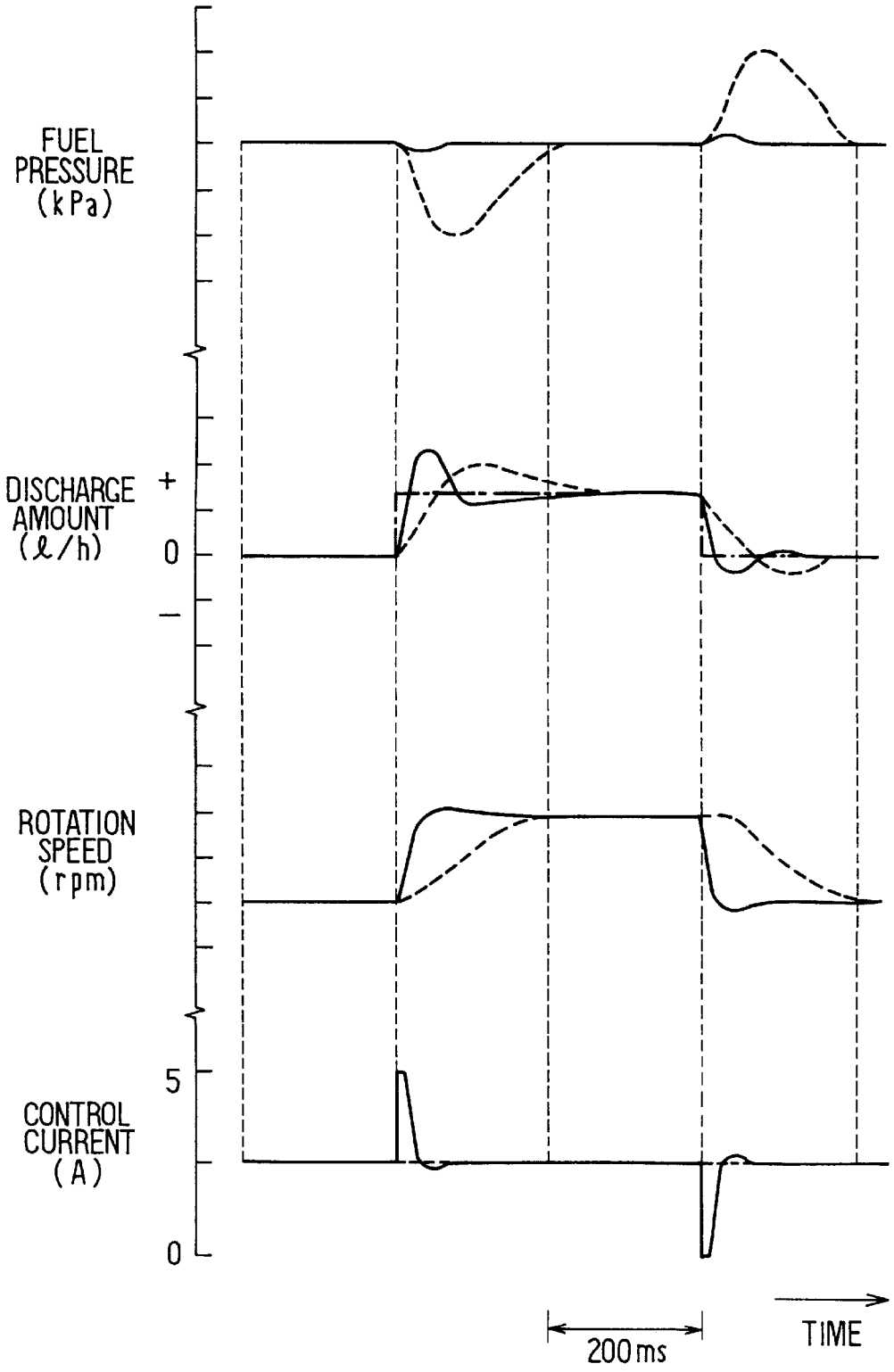
FIG. 7 is a time chart showing an example of control in the transitional period.
Figure 8A:
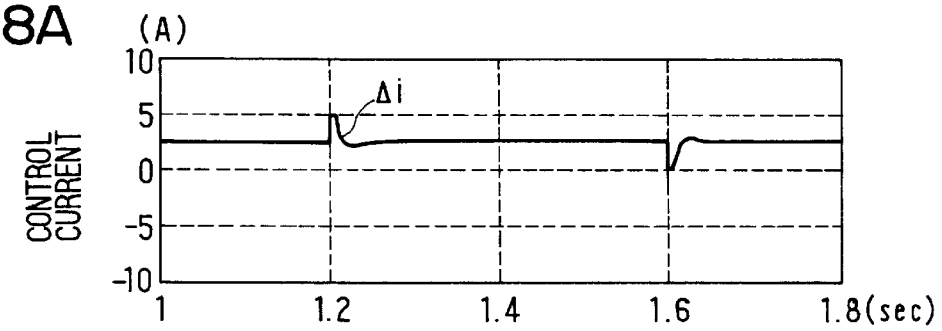
FIGS. 8A–8D are time charts showing relationships among the first and second differentiations of control current, compensating current and control current.
Figure 8B:
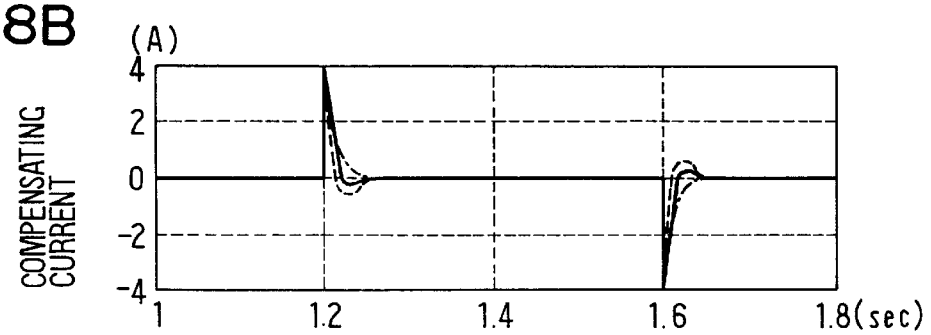
Figure 8C:
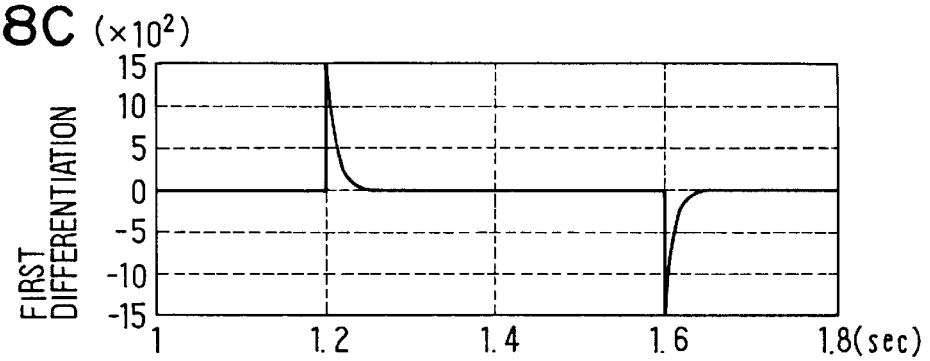
Figure 8D:
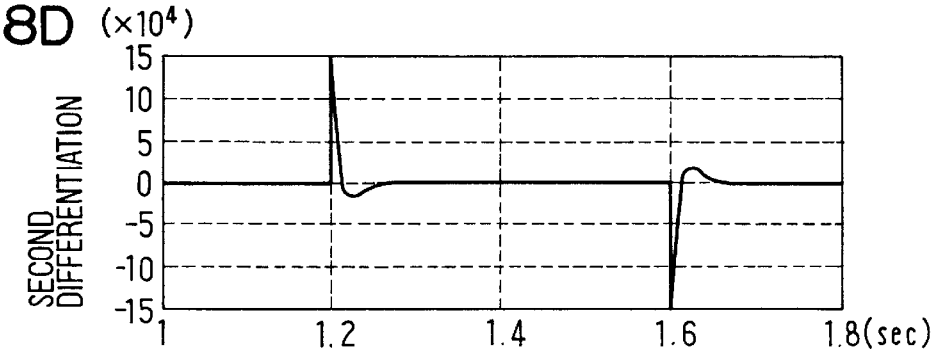

In the normal constant current control system shown by dotted lines in FIG. 7, since the control current supplied to the motor of the fuel pump 12 is constant even in the transitional period where amount of fuel injection changes rapidly, change of the rotation speed of fuel pump 12 (discharging capability) is delayed for sudden change of the amount of fuel injection (dot-chain line in FIG. 7) and thereby the tracking ability of the discharging amount for sudden change of the fuel injection is deteriorated. Therefore, the fuel pressure in the delivery pipe 18 changes to a large extent during the transitional period and the air-fuel ratio of the mixture to be supplied to the internal combustion engine is deviated, resulting in deterioration of emission and a drop in drivability.

On the other hand, in the case of this embodiment, as shown in FIGS. 8A–8D, the compensating current Δi is obtained by adding the value of fuel injection after the waveform shaping through the first differentiation (dot-chain line in FIG. 8B) and the value of fuel injection after waveform shaping through the second differentiation (dotted line in FIG. 8B) and then this compensating current Δi to the target current value to compensate for the control current of the fuel pump 12. Thereby, the rotation speed (discharging capability) of the fuel pump 12 changes with good tracking ability for change of amount of fuel injection during the transitional period, resulting in good followup characteristic of discharge amount for change of amount of fuel injection and thereby change of fuel pressure in the delivery pipe 18 during the transitional period can be controlled. This operational characteristics of this embodiment is shown by solid lines in FIG. 7. As a result, the air fuel ratio of the mixture to be supplied to the internal combustion engine is never deviated and thereby emission and drivability can be improved.

Moreover, in this embodiment, the control current is restricted to the range of 0 to 5A in order to reduce the load of the constant current type control circuit 23 and fuel pump 12. Thereby, the structure of the constant current type control circuit 23 can be simplified to realize cost-down and to protect the constant current type control circuit 23 and fuel pump 12 from overload condition and improve durability and reliability. However, it is of course possible that the control current is never restricted to the range from 0 to 5A.

(Second Embodiment)

The fuel transfer model of the first embodiment considers, as shown in FIG. 2, the model 32 simulating a transfer delay of fuel pressure in the fuel pipe system and the model 33 simulating expansion and compression of pipe volume depending on the elastic coefficient of the fuel pipe system.

Figure 12:
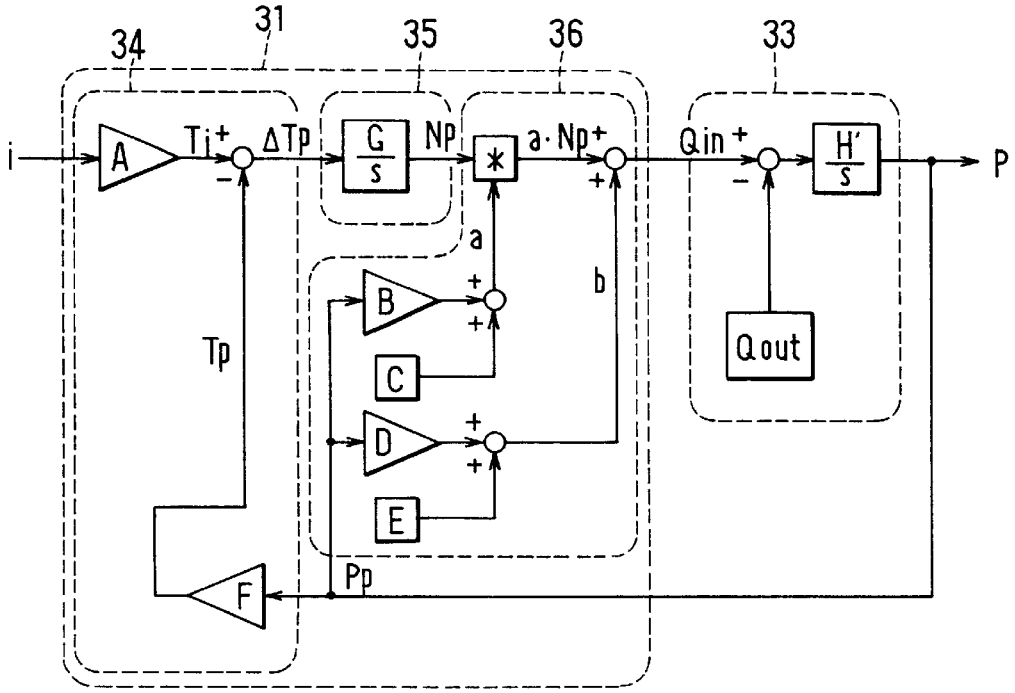
FIG. 12 is a structural diagram of a fuel transfer model of the second embodiment of the present invention.

Meanwhile, the fuel transfer model of the second embodiment has, as shown in FIG. 12, a structure in which the model 32 simulating a transfer delay of fuel pressure in the fuel pipe system by considering transfer delay of fuel pressure in the fuel pipe system as absorption of variation of fuel pressure due to expansion of the fuel pipe system. Therefore, the fuel transfer model of this embodiment is composed of the model 31 of the characteristic of the fuel pump 12 and the model 33 of the elastic coefficient of the fuel pipe system. The other is the same as that of the model of FIG. 2.

Figure 13:
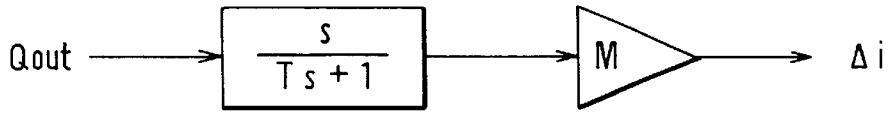
FIG. 13 is a structural diagram of a compensating current arithmetic operation model of the second embodiment of the present invention.

Moreover, the compensating current arithmetic operation model of the second embodiment obtains, as shown in FIG. 13, a compensating current Δi by multiplying a differential value (that is, amount of variation) of the amount of fuel injection Qout with a constant value M. Thereby, an adequate compensating current Δi can be set depending on a rate of variation of the amount of fuel injection Qout, enabling the fuel pressure control in which variation of fuel pressure during the transitional period can be controlled. In this second embodiment, the compensating current arithmetic operation model of FIG. 6 may also be used.

(Third Embodiment)

Figure 14:
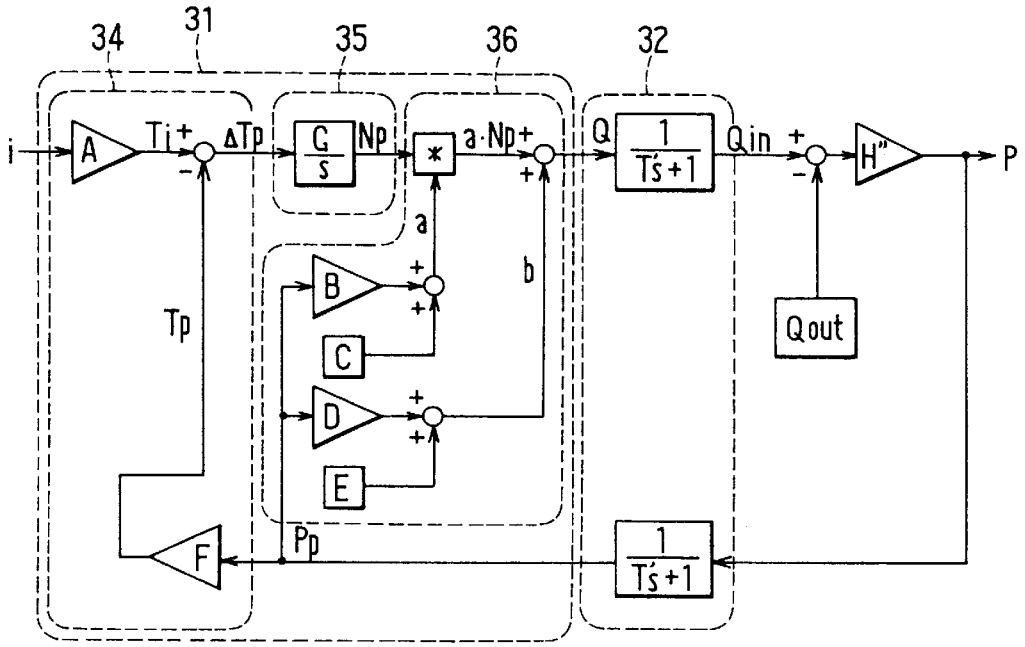
FIG. 14 is a structural diagram of a fuel transfer model of the third embodiment of the present invention.

In the third embodiment, the fuel transfer model is composed, as shown in FIG. 14, of the model 31 of the characteristic of the fuel pump 12 and the model 32 of the transfer delay of fuel pressure of the fuel pipe system by considering expansion depending on the elastic coefficient of the fuel pipe system as the transfer delay of fuel pressure of the fuel pipe system. In this case, variation P/dt of the fuel pressure P can be obtained from the following formula.

$$P/dt=(Qin-Qout)\cdot H''$$

(Qin: Amount of discharge, Qout: Amount of fuel injection, H": Constant)

As the compensating current arithmetic operation model, the compensating current arithmetic operation model shown in FIG. 6 or FIG. 13 may be used.

(Fourth Embodiment)

Figure 15:
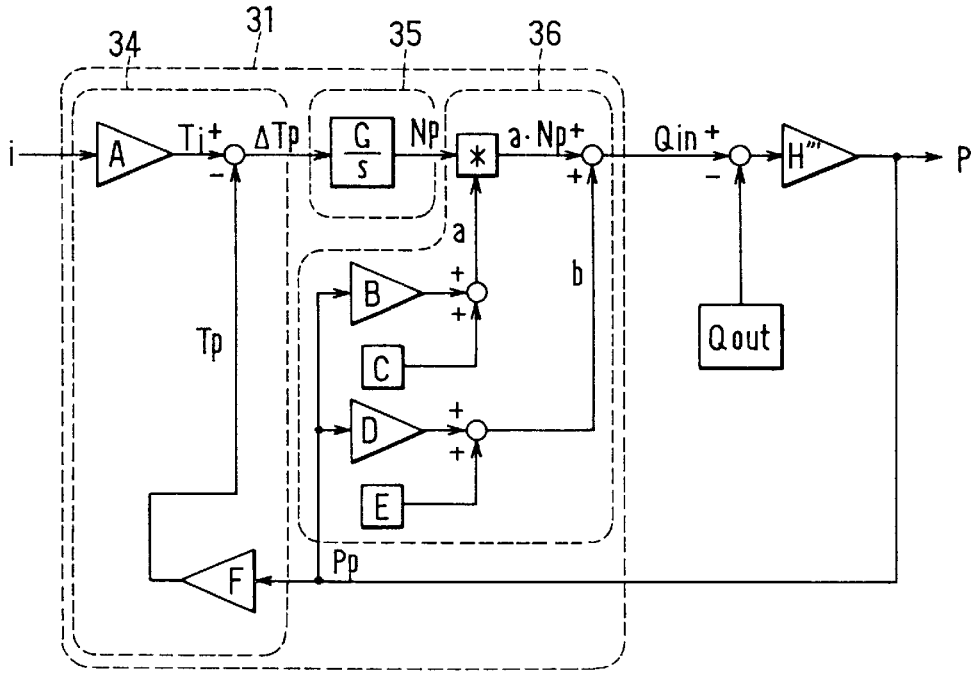
FIG. 15 is a structural diagram of a fuel transfer model of the fourth embodiment of the present invention.

In the fourth embodiment, a model simulating the characteristic (inertia, etc.) including the fuel pressure transfer delay and elastic coefficient of the fuel pipe system into the characteristic of the fuel pump 12 is used and the fuel transfer model is composed, as shown in FIG. 15, only of the characteristic model 31 of the fuel pump 12. In this case, the compensating current arithmetic operation model of FIG. 6 or FIG. 13 may be used as the compensating current arithmetic operation model.

(Fifth Embodiment)

Figure 16:
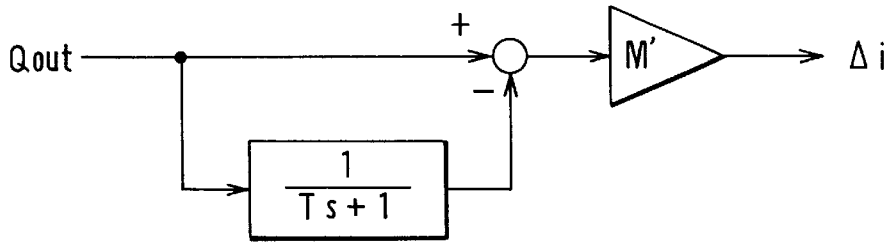
FIG. 16 is a structural diagram of a compensating current arithmetic operation model of the fifth embodiment of the present invention.

In the compensating current arithmetic operation model shown in FIG. 13, the compensating current Δi is obtained by multiplying the differentiated value of the amount of fuel injection Qout with a constant value M and such compensating current Δi is obtained, in the fifth embodiment, by multiplying a difference between the amount of fuel injection Qout and its first-order delay with a constant value M' as shown in FIG. 16. Even in this case, the compensating current Δi which is substantially equal to that of the compensating current arithmetic operation models of FIG. 13 and FIG. 16 can be obtained. In the case of the compensating current arithmetic operation models of FIG. 13 and FIG. 16, these models may be used as the simplified model for limiting the control current to a sufficiently lower value (for example, 0 to 5A) and thereby the circuit structure and arithmetic operation may be simplified.

(Sixth Embodiment)

Figure 17:
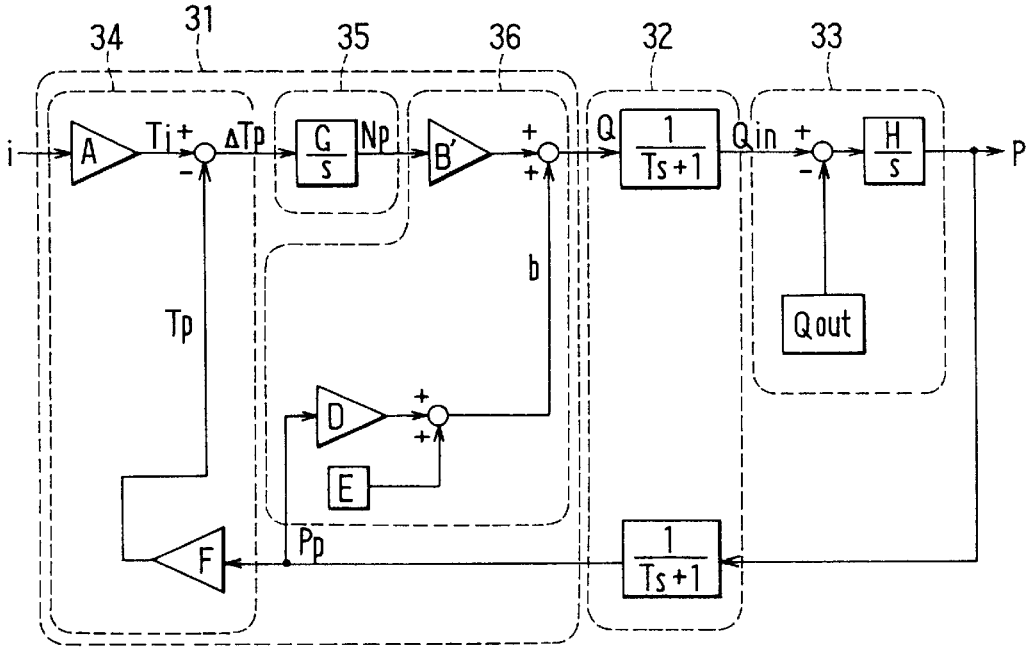
FIG. 17 is a structural diagram of a fuel transfer model of the sixth embodiment of the present invention.

The sixth embodiment uses a fuel transfer model shown in FIG. 17. This fuel transfer model has simplified, to enable simplified calculation of the inverse model (compensating current arithmetic operation model), the fuel pump model 36 simulating relationship among the rotation speed Np, fuel pressure Pp and 21. amount of discharge Q of the fuel pump 12. The other portions are same as that of the fuel transfer model of FIG. 2 used in the first embodiment.

The fuel pump model 36 used in the fuel transfer model of FIG. 17 simulates the relationship among the rotation speed Np, fuel pressure Pp and amount of discharge Q of the fuel pump 12 by the following formulae.

$$Q=B'\cdot Np+b$$

$$b=D\cdot Pp+E$$

(B', D, E: Constant)

The fuel transfer model of FIG. 17 can be expressed with the transfer function of the fuel pressure P, amount of fuel injection Qout and current i as indicated by the following formula (6) and response delay element of the fuel feeding system can be extracted from this transfer function.

$$P=G1(s)\cdot i+G2(s)\cdot Qout+G3(s) \quad (6)$$

Here, G1(s), G2(s), G3(s) can be expressed by the following formulae.

$$G1(s)=(AHGBTs+AHGB)/(T^2s^4+2Ts^3+s^2-HDs+FHGB)$$

$$G2(s)=-(HT^2s^3+2HTs^2+Hs)/(T^2s^4+2Ts^3+s^2-HDs+FHGB)$$

$$G3(s)=(HT^2s^3+2HTs^2+Hs/(T^2s^4+2Ts^3+s^2-HDs+FHGB)$$

Here, when a current to keep constant the fuel pressure P if the amount of fuel injection Qout has changed to Qout+ΔQout is assumed as i+Δi, the above formula (6) may be converted to the following formula (7).

$$P=G1(s)\cdot(i+\Delta i)+G2(s)\cdot(Qout+\Delta Qout)+G3(s) \quad (7)$$

From these formulae (6) and (7), the compensating current arithmetic operation model (inverse model) expressed by the following formula (8) can be derived.

$$\Delta i=-G2(s)/G1(s)\cdot\Delta Qout \quad (8)$$

The compensating current arithmetic operation model can be expressed by the following formula by summarizing the formula (8).

$$\Delta J\times\{s/(T6\cdot+1)\}\times\{(T5\cdot s+1)/(T7\cdot s+1)\}\times\Delta Qout$$ (J:constant, T5, T6, T7:Time constant)

When the compensating current Δi is calculated using the formula of this compensating current arithmetic operation model, the rotation speed (discharging capability) of the fuel pump 12 varies with good tracking ability to change in the amount of fuel injection Qout during the transitional period and thereby variation of fuel pressure in the delivery pipe 18 can be controlled during the transitional period. As a result, the air-fuel ratio of the mixture to be supplied to the internal combustion engine is less deviated and exhaust emission and drivability can be improved even in the transitional period.

(Seventh Embodiment)

Figure 18:
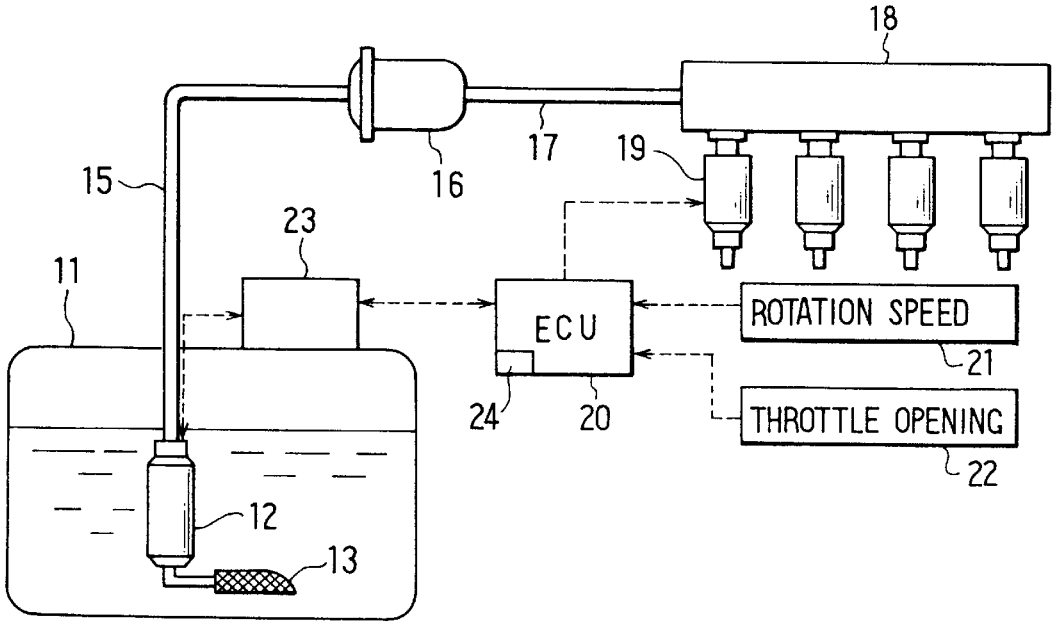
FIG. 18 is a schematic structural diagram of a fuel feeding system showing the seventh embodiment of the present invention.

In the system structure of FIG. 1 described in the first embodiment, the compensating current arithmetic operation circuit 24 is provided in the constant current type control circuit 23, but in the seventh embodiment shown in FIG. 18, the compensating current arithmetic operation circuit 24 is provided within the engine control unit 20. In this case, the compensating current arithmetic operation circuit 24 may be structured with hardware but the same function may also be realized with a software (program) executed by the microcomputer in the engine control unit 20.

In this seventh embodiment, the compensating current Δi may also be calculated depending on the compensating current arithmetic operation model used in any embodiment described above.

(Other Embodiment)

The first to seventh embodiments described above discloses the present invention applied to the fuel feeding system of the constant current control system in which a control current of the fuel pump 12 is controlled to a constant value, but the present invention may also be applied to the fuel feeding system of the voltage control system in which a fuel pressure sensor is provided to detect a fuel pressure of the fuel pipe system and the applied voltage of the fuel pump may be feedback controlled to match the fuel pressure to the target fuel pressure depending on the detection result of the fuel pressure. In this case, the compensating voltage may be obtained using any model among those described above to compensate for the target voltage with this compensated voltage.

Although preferred embodiments of the present invention have been described and illustrated, it will be apparent to those skilled in the art that various modifications may be made without departing from the principles of the invention.

What is claimed is:

1. Fuel supply apparatus for an internal combustion engine, said apparatus comprising:

a fuel pump for transferring fuel to fuel injectors; and fuel pump control means for adjusting fuel pressure fed to said injectors by controlling said fuel pump, wherein said fuel pump control means includes:

basic control amount calculating means for calculating a basic control amount tending to cause fuel pressure to become equal to a target fuel pressure;

compensation amount calculating means for continuously calculating in real time a compensation amount for compensating delayed response of the fuel supply system depending on the difference between a first-order delay of a fuel injection amount and an actual fuel injection amount and using a single mathematical algorithm whether or not the amount of fuel being consumed by the injectors is in a transient state; and control amount calculating means for calculating a fuel pump control amount depending on said basic control amount and said compensation amount.

2. Fuel supply apparatus for an internal combustion engine, said apparatus comprising:

a fuel pump for transferring fuel to fuel injectors; and fuel pump control means for adjusting fuel pressure fed to said injectors by controlling said fuel pump, wherein said fuel pump control means includes:

basic control amount calculating means for calculating a basic control amount so that the fuel pressure tends to become equal to a target fuel pressure;

compensation amount calculating means for continuously calculating in real time a compensation amount for response delay of the fuel supply system depending on variation in the rate at which fuel is supplied to said injectors by use of a single mathematical algorithm whether or not the amount of fuel being consumed by the injectors is in a transient state said compensation amount being calculated from a difference between a first-order delay of a fuel injection amount and an actual present fuel injection amount; and control amount calculating means for calculating a fuel pump control amount depending on said basic control amount and said compensation amount.

3. Fuel supply apparatus as in claim 1 wherein the compensation amount calculating means operates continuously whether or not the amount of fuel being consumed by the injectors is in a transient state.

4. A fuel injection control system comprising:

a fuel pump connected to a returnless conduit supplying fuel to fuel injectors of an internal combustion engine; and a fuel pump control connected to supply electrical driving current to a fuel pump motor during both constant and transient engine operating conditions based on continuously repeated real time evaluations of the same single mathematical algorithmic model of the fuel pump, returnless conduct and fuel injectors regardless of whether constant or transient engine operating conditions are currently present, said evaluations including a compensation amount based on a difference between a first order delay of a fuel injection amount and actual current fuel injection amount.

5. A fuel injection control system comprising:

a fuel pump connected to a returnless conduit supplying fuel to fuel injectors of an internal combustion engine; and a fuel pump control connected to supply electrical driving current to a fuel pump motor during both constant and transient engine operating conditions based on an added compensation factor derived in real time from the difference between a first-order time delay of demanded fuel injection amount and an actual fuel injection amount using a single predetermined mathematical algorithm regardless of whether constant or transient engine operating conditions are currently present said compensation amount being calculated from a difference between a first-order delay of a fuel injection amount and an actual present fuel injection amount.

6. A fuel injection control system comprising:

a fuel pump connected to a returnless conduit supplying fuel to fuel injectors of an internal combustion engine; and a fuel pump control connected to supply electrical driving current to a fuel pump motor during both constant and transient engine operating conditions based on an added compensation factor derived in real time from detected variation in the rate at which fuel is supplied to the fuel injectors using a single predetermined mathematical algorithm regardless of whether constant or transient engine operating conditions are currently present said compensation amount being calculated from a difference between a first-order delay of a fuel injection amount and an actual present fuel injection amount.

7. A method for controlling a fuel injection system, said method comprising:

supplying fuel to fuel injectors of an internal combustion engine using a fuel pump connected to a returnless conduit; and supplying electrical driving current to a fuel pump motor during both constant and transient engine operating conditions based on continuously repeated real time evaluations of the same single mathematical algorithm model of the fuel pump, returnless conduit and fuel injectors regardless of whether constant or transient engine operating conditions are currently present, said evaluations including a compensation amount based on a difference between a first order delay of a fuel injection amount and actual current fuel injection amount.

8. A method for controlling a fuel injector system, said method comprising:

supplying fuel to fuel injectors of an internal combustion engine via a fuel pump connected to a returnless conduit; and supplying electrical driving current to a fuel pump motor during both constant and transient engine operating conditions based on an added compensation factor derived in real time from the difference between a first-order time delay of demanded fuel injection amount and an actual fuel injection amount using a single predetermined mathematical algorithm regardless of whether constant or transient engine operating conditions are currently present said compensation amount being calculated from a difference between a first-order delay of a fuel infection amount and an actual present fuel injection amount.

9. A method for controlling a fuel injection system, said method comprising:

supplying fuel to fuel injectors of an internal combustion engine via a fuel pump connected to a returnless conduit; and supplying electrical driving current to a fuel pump motor during both constant and transient engine operating conditions based on an added compensation factor derived in real time from detected variation in the rate at which fuel is supplied to the fuel injectors using a single predetermined mathematical algorithm regardless of whether constant or transient engine operating conditions are currently present said compensation amount being calculated from a difference between a first-order delay of a fuel injection amount and an actual present fuel injection amount.

10. A method for controlling a fuel injection system, said method comprising:

supplying fuel to fuel injectors of an internal combustion engine using a fuel pump connected to a returnless conduit; and supplying electrical driving current to a fuel pump motor by:

(i) calculating a basic control value tending to cause fuel pressure to equal a target value;

(ii) calculating in real time a fuel supply system response compensation value for compensating delayed response of the fuel supply system said compensation amount being calculated from a difference between a first-order delay of a fuel injection amount and an actual present fuel injection amount;

(iii) combining said basic control value and said response compensation value to produce a fuel pump control current value for supplying current to said motor; and (iv) repeating the same steps (i) through (iii) in real time throughout both transient and non-transient engine driving conditions to thereby automatically correct for transient conditions without the necessity of detecting the rate of transitional variations and using that to look up stored mapped compensation data.

11. Apparatus for controlling a fuel injection system, said apparatus comprising:

means for supplying fuel to fuel injectors of an internal combustion engine using a fuel pump connected to a returnless conduit; and means for supplying electrical driving current to a fuel pump motor including:

(i) means for calculating a basic control value tending to cause fuel pressure to equal a target value;

(ii) means for calculating in real time a fuel supply system response compensation value for compensating delayed response of the fuel supply system said compensation amount being calculated from a difference between a first-order delay of a fuel injection amount and an actual present fuel injection amount;

(iii) means for combining said basic control value and said response compensation value to produce a fuel pump control current value for supplying current to said motor; and (iv) means for repeatively operating the same means (i) through (iii) in real time throughout both transient and non-transient engine driving conditions to thereby automatically correct for transient conditions without the necessity of detecting the rate of transitional variations and using that to look up stored mapped compensation data.

* * * * *